US006700559B1

(12) United States Patent
Tanaka et al.

(10) Patent No.: US 6,700,559 B1
(45) Date of Patent: Mar. 2, 2004

(54) LIQUID CRYSTAL DISPLAY UNIT HAVING FINE COLOR CONTROL

(75) Inventors: Seiichi Tanaka, Chiba (JP); Hajime Shimizu, Tokyo (JP); Takayuki Nakajima, Toride (JP)

(73) Assignee: Sharp Kabushiki Kaisha, Osaka (JP)

( * ) Notice: Subject to any disclaimer, the term of this patent is extended or adjusted under 35 U.S.C. 154(b) by 32 days.

(21) Appl. No.: 09/689,618

(22) Filed: Oct. 13, 2000

(30) Foreign Application Priority Data

Oct. 13, 1999 (JP) ..... 11-291299

(51) Int. Cl.[7] ..... G09G 3/36

(52) U.S. Cl. ..... 345/88; 345/600; 345/601; 345/690

(58) Field of Search ..... 345/87, 88, 89, 345/98, 99, 204, 690–693, 589, 596, 600, 601, 605; 348/671–686; 358/455–457

(56) References Cited

U.S. PATENT DOCUMENTS 4,930,010 A * 5/1990 MacDonald ..... 358/530
5,442,355 A * 8/1995 Cummins ..... 341/145
5,956,006 A * 9/1999 Sato ..... 345/88
6,115,014 A * 9/2000 Aoki et al. ..... 345/88
6,288,698 B1 * 9/2001 Ishii et al. ..... 345/87
6,380,916 B1 * 4/2002 Kim ..... 345/88
6,388,648 B1 * 5/2002 Clifton et al. ..... 345/88
6,414,664 B1 * 7/2002 Conover et al. ..... 345/89

FOREIGN PATENT DOCUMENTS

JP 05027711 A 2/1993
JP 11032237 A 2/1999

* cited by examiner

*Primary Examiner*—Amr Awad
(74) *Attorney, Agent, or Firm*—Birch, Stewart, Kolasch & Birch, LLP

(57) ABSTRACT

Eight-bit digital image data of R, G and B output from an image data memory are corrected by conversion controllers to meet characteristics of a liquid crystal panel. The corrected data are input to a liquid crystal drive circuit as digital image data, and an image is displayed on the liquid crystal panel. A LUT stored in a LUT reference processor stores data (addresses) by a number that makes it possible to refer to input image digital data at one to one. A random number generator is for generating random numbers and supplying the random numbers to a round-to-integer processor as threshold value data. The round-to-integer processor compares the data referred to by the LUT reference processor with the threshold data, and carries out a round-to-integer processing.

15 Claims, 14 Drawing Sheets

| | | | |
|---|---|---|---|
| 0x0 | 0x8 | 0x2 | 0xA |
| 0xC | 0x4 | 0xE | 0x6 |
| 0x3 | 0xB | 0x1 | 0x9 |
| 0xF | 0x7 | 0xD | 0x5 |

LIQUID CRYSTAL DISPLAY UNIT HAVING FINE COLOR CONTROL

BACKGROUND OF THE INVENTION

1. Field of the Invention

The present invention relates to a liquid crystal display unit that is used as a monitor for a personal computer (hereinafter to be referred to as a PC), a word processor, etc., and further as a display for a television receiver, and a projector. More specifically, the present invention relates to a liquid crystal display unit that carries out a control for matching an image to be displayed with the characteristics of a liquid crystal panel in order to obtain an image of a satisfactory color balance.

2. Description of the Prior Art

In recent years, along with the development of a liquid crystal panel having higher resolution and fuller color range, there has been an increase in demand for liquid crystal display units that have features such as low voltage driven, thin and light weight, in the information equipment field including personal computers as main products, and in the image equipment field including television receivers and projectors as main products.

Two widely used liquid crystal display units include a twisted nematic (TN) liquid crystal and a super twisted nematic (STN) liquid crystal. The super twisted neumatic liquid crystal has a transmission characteristic of improved sharpness due to its large twist angle. A driving system for the liquid crystal display units has shifted from a segment driving type, initially introduced, to a matrix driving type in order to realize a higher resolution. The matrix driving type has a pair of transparent electrodes divided into two and disposed to be mutually orthogonal with each other, each having a belt shape, with one transparent electrode working as a scanning electrode and the other as a signal electrode. Points of intersection between these electrodes form pixels, and they are selectively applied with voltages to display optional image information. This matrix driving type is broadly divided into a simple matrix type and an active matrix type that uses switching elements. Particularly, an active matrix driving type liquid crystal display that uses a thin-film transistor (TFT) can obtain a high resolution and a high contrast, and therefore, has been widely distributed.

The TFT active matrix liquid crystal will be explained in detail.

Figure 1:
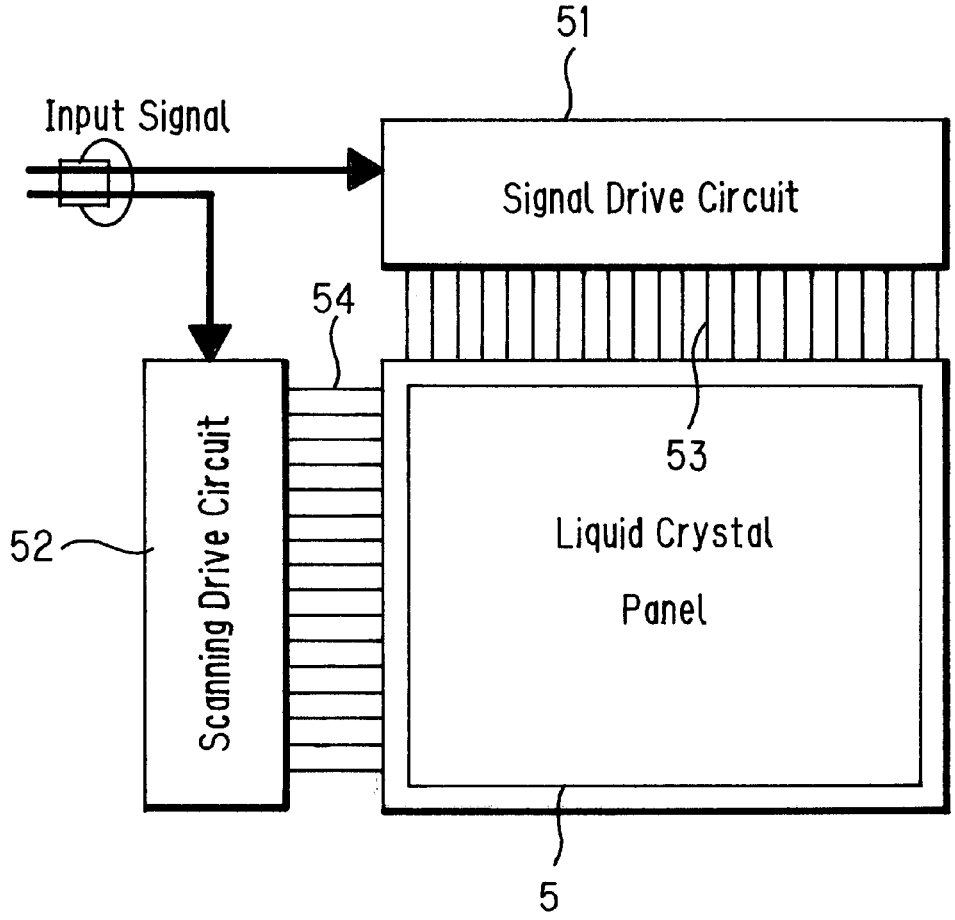
FIG. 1 PRIOR ART

FIG. 1 is a functional block diagram for explaining a liquid crystal driving system. As shown in FIG. 1, a reference number 51 denotes a signal electrode drive circuit, 52 denotes a scanning electrode drive circuit, and 5 denotes a liquid crystal display panel. The scanning electrode drive circuit 52 is constructed of a shift register circuit. The output of the scanning electrode drive circuit 52 is produced from a lateral line transparent electrode 54 and is applied to a gate of a TFT that is connected in parallel in a horizontal direction on the liquid crystal panel 5. The signal electrode drive circuit 51 is constructed of a shift register and a sample holding circuit. The output of the signal electrode drive circuit 51 is produced from a vertical line transparent electrode 53 and is applied to a drain or a source of a TFT that is arrayed in a perpendicular direction on the liquid crystal panel 5. When a scanning signal is added to the gates of these TFT's, a current is conducted between the source and the drain. When an image signal is added to the source or the drain, the liquid crystal layer is charged and is applied with an electric charge. The applied electric charge is held until the next scanning signal is given. The volume of light that passes through the liquid crystal layer changes according to the voltage applied to the liquid crystal layer. Therefore, it is possible to control the optical transmission volume by the image signal voltage. In other words, the scanning electrode drive circuit 52 turns ON the TFT in the horizontal direction together, and during this period, the signal electrode drive circuit 51 writes image information of one line component into pixels of each intersection point. This is sequentially scanned in the vertical direction to thereby display the image information.

The development of color display technology for the liquid crystal display panel is also progressing with the development of the high-resolution technology. As general methods of color display, there are a color filtering method that has RGB filters corresponding to each pixel disposed on the surface of the liquid crystal, and a three-panel method that provides a liquid crystal panel to each RGB image and supplies a back light or a front light of RGB to each liquid crystal panel. Both methods form a display of a color image for each of the RGB components, and adds and mixes these color components to display the color image. The color filtering method has features of compactness and lightweight, and has been widely distributed in PC monitors and liquid crystal TVs. The three-panel method has a large device scale but can obtain an image of a high resolution and a high luminance. Therefore, this method has been applied to liquid crystal projectors and the like.

Two input types of liquid crystal display units have been widely used. One is an analog interface liquid crystal display unit that inputs conventional video signals of conventional TV's and videos, and the other is a digital interface liquid crystal display unit that is capable of directly inputting digital video data of PC's. In recent years, digitization of video data has progressed rapidly along with the development of digital technology, due to increasing memory capacities as well as increasing processing capacity. Digital data can be more easily processed for the editing of videos like a non-linear editing than analog data. Further, digital data has no deterioration in image quality, and can be compressed at a high compression rate. Therefore, it is considered that the digitization of images will be further promoted in future. For the image digital data, various formats have been proposed because of a difference between a moving image and a still image, and a difference in compression methods. At present, digital data generally has eight bits (256 gradations) for each of R, G and B, and the data can be used to display full colors of about 1.63 million colors based on additive mixture of color stimuli.

Liquid crystal display panels as the display element have unique optical rotary dispersion characteristics. Optical rotary dispersion characteristics are a phenomenon where the optical transmittance changes depending on the wavelength of light and depending on the voltage. More specifically, a red color component (a long-wavelength area) becomes large and a blue color component (a short-wavelength area) becomes small in the optical transmittance during an application of a low voltage. Therefore, even when a gray scale is displayed, the white balance in each gradation is disturbed, and a coloring occurs according to the voltage applied. This not only causes an inconvenience in the gray scale display, but also interferes with color display performance. Particularly, there is a problem that when a gray portion such as a shade exists in the image, a color appears in this portion.

Further, in the color image display according to this color filtering method, a light from the pixel does not enter the corresponding RGB filter in an ideal manner, and the light leaks to another filter, which causes RGB crosstalk. This RGB crosstalk disturbs the color balance, and makes it impossible to reproduce a desired color.

Optical Compensation Technique

A double-layer STN liquid crystal (DSTN) method is an example that solves the problem of the coloring attributable to the optical rotary dispersion characteristics. According to this method, two liquid crystal panels having optical rotary dispersion characteristics in opposite directions are superimposed with each other, and a coloring generated by a first-layer liquid crystal panel is canceled by a second-layer optical compensation liquid crystal panel, thereby achieving non-coloring. This method can substantially compensate for the optical rotary dispersion characteristics. However, this method also has many problems because the cost, the weight and the thickness are doubled and the manufacturing process is complex.

There has also been developed a technique for preventing the coloring problem by superimposing a phase compensation plate with a liquid crystal panel. For this phase compensation plate, there has been proposed a phase difference plate that is prepared by stretching in one axis direction a polymer film made of polyester, polyvinyl alcohol, or the like. This method can achieve a lightweight at low cost. However, it is impossible to completely match the phase-difference wavelength dispersion characteristics of the liquid crystal panel with the phase-difference wavelength dispersion characteristics of the polymer film. Therefore, it is not possible to compensate for the phase difference over the whole visible area. Further, there has also been proposed a technique having a pseudo twist structure by laminating a plurality of phase difference plates, with the optical axis of each plate shifted. However, this method has a problem of being costly and the contrast is lowered. In recent years, there has also been developed a compensation plate made of a liquid crystal polymer film of a cholesteric phase that has an inverse twisted structure. However, it is difficult to prepare a film that matches with the optical rotary dispersion characteristics of the liquid crystal panel. Therefore, there is a limit to non-coloring.

Compensation Technique of the Signal Control System

Figure 2:
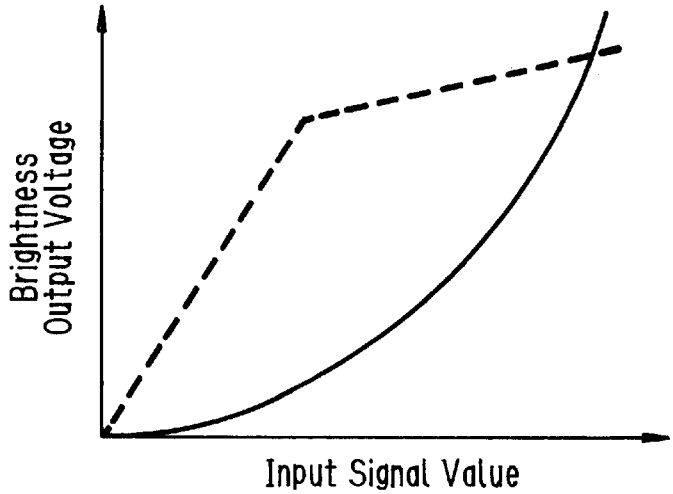
FIG. 2 PRIOR ART
Figure 3:
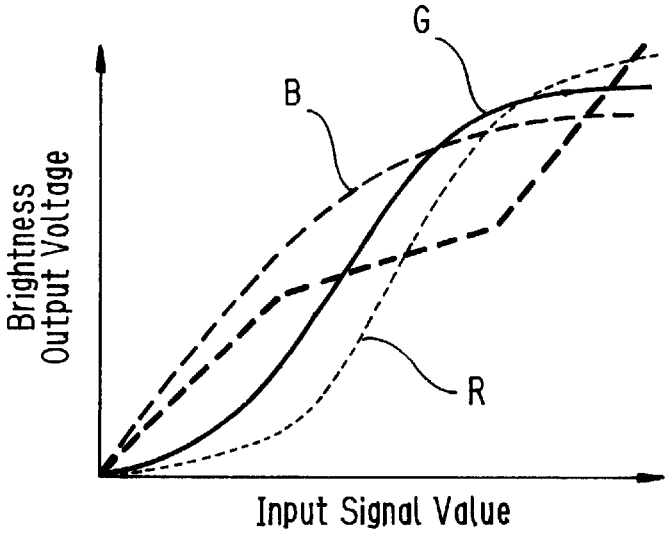
FIG. 3 PRIOR ART

In the meantime, a technique for compensating for the coloring and the color balance by controlling and adjusting the image signal has been developed. This signal control adjustment has also been implemented in a CRT display as a conventional technique called white balance adjustment and gamma correction. In the CRT display, the spectrum characteristics of a fluorescent substance disposed on the surface of the display and the voltage luminance characteristics, that are a relationship between the drive voltage and the anode current, are compensated for. A curve that shows this relationship is as shown by a solid line in FIG. 2. This curve can be approximated by a straight line having a predetermined slope when it is expressed by logarithmic scale (gamma 2.2 curve). Therefore, it has been possible to obtain sufficient compensation by the gamma correction of a one-point bent line as shown by a broken line and by the white balance adjustment for adjusting the gain of each of the RGB signals at a constant rate, as shown in FIG. 2. This control technique has been implemented by an analog control using a transistor or a variable resistor. However, as shown in FIG. 3 the characteristic curve generated from the voltage luminance characteristics and the optical rotary dispersion characteristics of the liquid crystal panel is substantially irregular as compared with the characteristics of the CRT. Therefore, it has been difficult to carry out a sufficient compensation even if the conventional signal control technique for the CRT would be directly applied to the liquid crystal panel.

Further, in FIG. 3, the gamma correction for a liquid crystal panel by a two-point bent line as shown by a broken line is achieved as the analog control. However, according to this method, it has been difficult to carry out a fine adjustment, and there has been a limit to the correction of the characteristics of the liquid crystal. Further, considering the problem of the above-described RGB crosstalk, it has been impossible to carry out the correction by this method. Therefore, further improvements in this method are required.

As described above, in recent years, there has been an increase in demand for digital control processing that can carry out a fine control in circumstances where the digitization of image data has been widely promoted. Digital signal control techniques, include a method of correcting the RGB image data by a linear matrix conversion, a method of using a LUT (lookup table), a method of converting by approximation using a function, etc. A technique relating to the linear matrix conversion has been disclosed in Japanese Patent Application Laid-open Hei 5 No. 27711. According to Japanese Patent Application Laid-open Hei 5 No. 27711, a device is disclosed that changes a matrix coefficient according to an input luminance level of a digital signal of each of RGB colors in a liquid crystal display unit that converts a digital signal of each of RGB colors by a matrix circuit of 3×3. According to Japanese Patent Application Laid-open Hei 5 No. 27711, another signal component is added to each of the RGB signals, and the chromaticity point displayed on the screen is shifted, thereby compensating the optical rotary dispersion characteristics which are particular to the liquid crystal panel.

Figure 4:
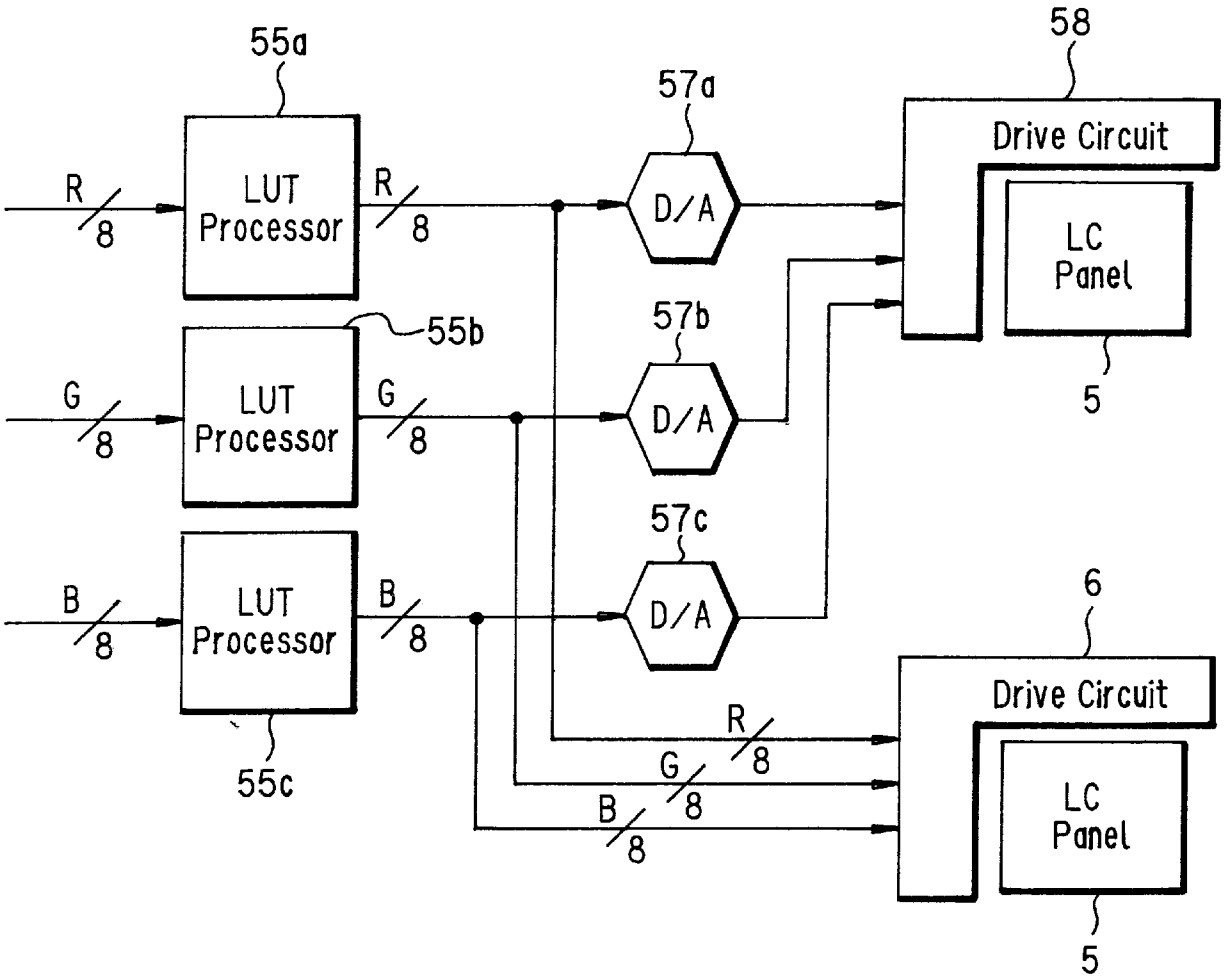
FIG. 4 PRIOR ART

In FIG. 4, RGB eight-bit image data are input to LUT processors 55*a*, 55*b* and 55*c*, respectively, and are corrected. Thereafter, the image signals are either supplied as digital data straight to a digital interface liquid crystal drive circuit 6, or are supplied as digital data to D/A converters 57*a*, 57*b* and 57*c* so that the data are D/A converted there and are then supplied to an analog interface liquid crystal drive circuit 58. The LUT processors 55*a*, 55*b* and 55*c* store data for correcting the optical rotary dispersion characteristics of the liquid crystal panel 5, and refer to the output data after the input data has been corrected. This LUT method uses a large volume of data, but can carry out a substantially finer correction than the correction carried out by the above-described approximation by a function and linear matrix conversion.

However, according to any one of the corrections carried out by the digital control processing disclosed in the above-described prior art, problems occur in each eight-bit color of RGB that is the main signal of the digital image. When a high-precision correction calculation has been carried out by the above-described digital control processing, the corrected data has information volume of eight bits or more in many cases. More specifically, as a result of a correction calculation carried out for eight-bit RBG data (100, 100, 100), for example, data is obtained as data converted into twelve-bit data of eight bits of an integer portion+four bits below a decimal point such as (100.16, 97.32, 120.64). In general, the twelve-bit data obtained by the conversion is directly D/A converted and the analog data is supplied to the analog interface liquid crystal display unit. However, a D/A converter circuit having such a large number of bits is expensive and would cause an increase in cost of the device.

Further, when the converted data is stored as eight-bit color data or is supplied to the digital interface of the liquid crystal display unit, the number below a decimal point is rounded off or is rounded to an integer. Therefore, a fine error occurs. It is known that the human visual system has a color adaptation effect that when a gray scale is colored, this colored gray scale is sensed as non-color by adapting this color to a background color when these colors (color phases) are similar color. Color contrast is characterized by, when a scale of a complementary color relationship such as red and green or blue and yellow is close to a gray scale, even a slight color in the gray scale is sensed strong, and further at a boundary portion where the scale is in contact, even a color that does not physically and optically exist is sensed. The optical rotary dispersion characteristics and the RGB crosstalk of a liquid crystal panel have a high possibility that different coloring occurs. As a result, there occurs a problem that because of the above-described color contrast characteristics of the human visual system the coloring is sensed with an emphasis, or even a color that does not physically and optically exist is sensed at a boundary portion that is in contact.

SUMMARY OF THE INVETION

In order to solve the above problems, the present invention has been provided. It is an object of the invention to provide a liquid crystal display unit that can correct color reproduction particular to a liquid crystal panel by a digital signal control, that can process the correction in high precision, and that can reduce the sensing of a coloring of a gray scale attributable to a fine error generated by the digital signal control.

The present invention has been made in order to achieve the above object, the details of which are as follows.

According to a first aspect of the present invention, a liquid crystal display unit comprises:

a liquid crystal panel that can display a color image;

a liquid crystal drive circuit that drives the liquid crystal panel; and a conversion controller that controls the conversion of image digital data consisting of digital signals of R, G and B respectively, and supplies the converted data to the liquid crystal drive circuit, wherein the conversion controller comprises:

correcting means that corrects the image digital data to carry out a color reproduction that meets characteristics of the liquid crystal panel; and color improving means that adds a fine variation to the corrected image digital data.

Further, according to a second aspect of the invention, a liquid crystal display unit according to the first aspect, further comprises:

an image data memory that stores image digital data and supplies it to the conversion controller, wherein the liquid crystal drive circuit is driven by digital signals from the conversion controller.

Further, according to a third aspect of the invention, liquid crystal display unit according to the first aspect, further comprises:

an A/D converter that converts analog input signals of R, G and B respectively that are color image signals input from the outside of the unit into digital signals, and supplies the digital signals to the conversion controller; and a D/A converter that converts image digital data from the conversion controller into analog signals, and supplies the analog signals to the liquid crystal drive circuit, wherein the liquid crystal drive circuit is driven by analog signals from the D/A converter.

Further, according to a fourth aspect of the invention, a liquid crystal display unit according to the first, second or third aspect is characterized in that the correcting means carries out a correction by referring to a lookup table consisting of characteristic data of the liquid crystal panel, and each data of the lookup table that becomes the corrected data has bits of a larger number than the number of bits of the image digital data.

Further, according to a fifth aspect of the invention, a liquid crystal display unit according to the first, second or third aspect is characterized in that the correcting means carries out a correction calculation using a functional expression by approximating characteristic data of the liquid crystal panel, and the corrected data has bits of a larger number than the number of bits of the image digital data.

Further, according to a sixth aspect of the invention, a liquid crystal display unit according to the first, second or third aspect is characterized in that the correcting means carries out a correction by linearly matrix converting the image digital data using a matrix coefficient that has been calculated from characteristic data of the liquid crystal panel, and the corrected data has bits of a larger number than the number of bits of the image digital data.

Further, according to a seventh aspect of the invention, a liquid crystal display unit according to the fourth aspect is characterized in that the color improving means has a random number generator that generates a random threshold value, and changes the corrected data into an integer by the random threshold value, thereby to add a fine variation.

Further, according to an eighth aspect of the invention, a liquid crystal display unit according to the fifth aspect is characterized in that the color improving means has a random number generator that generates a random threshold value, and changes the corrected data into an integer by the random threshold value, thereby to add a fine variation.

Further, according to a ninth aspect of the invention, a liquid crystal display unit according to the sixth aspect is characterized in that the color improving means has a random number generator that generates a random threshold value, and changes the corrected data into an integer by the random threshold value, thereby to add a fine variation.

Further, according to a tenth aspect of the invention, a liquid crystal display unit according to the fourth aspect is characterized in that the color improving means stores a dither matrix pattern, and changes the corrected data into an integer by a threshold value obtained from the dither matrix pattern, thereby to add a fine variation.

Further, according to an eleventh aspect of the invention, a liquid crystal display unit according to the fifth aspect is characterized in that the color improving means stores a dither matrix pattern, and changes the corrected data into an integer by a threshold value obtained from the dither matrix pattern, thereby to add a fine variation.

Further, according to a twelfth aspect of the invention, a liquid crystal display unit according to the sixth aspect in characterized in that the color improving means stores a dither matrix pattern, and changes the corrected data into an integer by a threshold value obtained from the dither matrix pattern, thereby to add a fine variation.

Further, according to a thirteenth aspect of the invention, a liquid crystal display unit according to the tenth aspect is characterized in that the color improving means stores the dither matrix patterns separately in the image data of R, G and B respectively, and can change a variation that is added to the image data of R, G and B respectively.

Further, according to a fourteenth aspect of the invention, a liquid crystal display unit according to the eleventh aspect is characterized in that the color improving means stores the dither matrix patterns separately in the image data of R. G and B respectively, and can change a variation that is added to the image data of R, G and B respectively.

Further, according to a fifteenth aspect of the invention, a liquid crystal display unit according to the twelfth aspect is characterized in that the color improving means stores the dither matrix patterns separately in the image data of R, G and B respectively, and can change a variation that is added to the image data of R, G and B respectively.

In the present invention, the correcting means of the conversion controller can correct the color reproduction by a digital signal control according to the optical rotary dispersion characteristics that is the phenomenon which is particular to the liquid crystal panel. Further, as the color improving means adds a fine variation, the coloring of the gray that becomes the problem in the digital control processing consists of color components that are minutely different. Therefore, it is possible to reduce the emphasizing of the coloring due to the color contrast and the sensing of a color that does not physically and optically exist at the boundary portion.

BRIEF DESCTIPTION OF THE DRAWINGS

Figure 5:
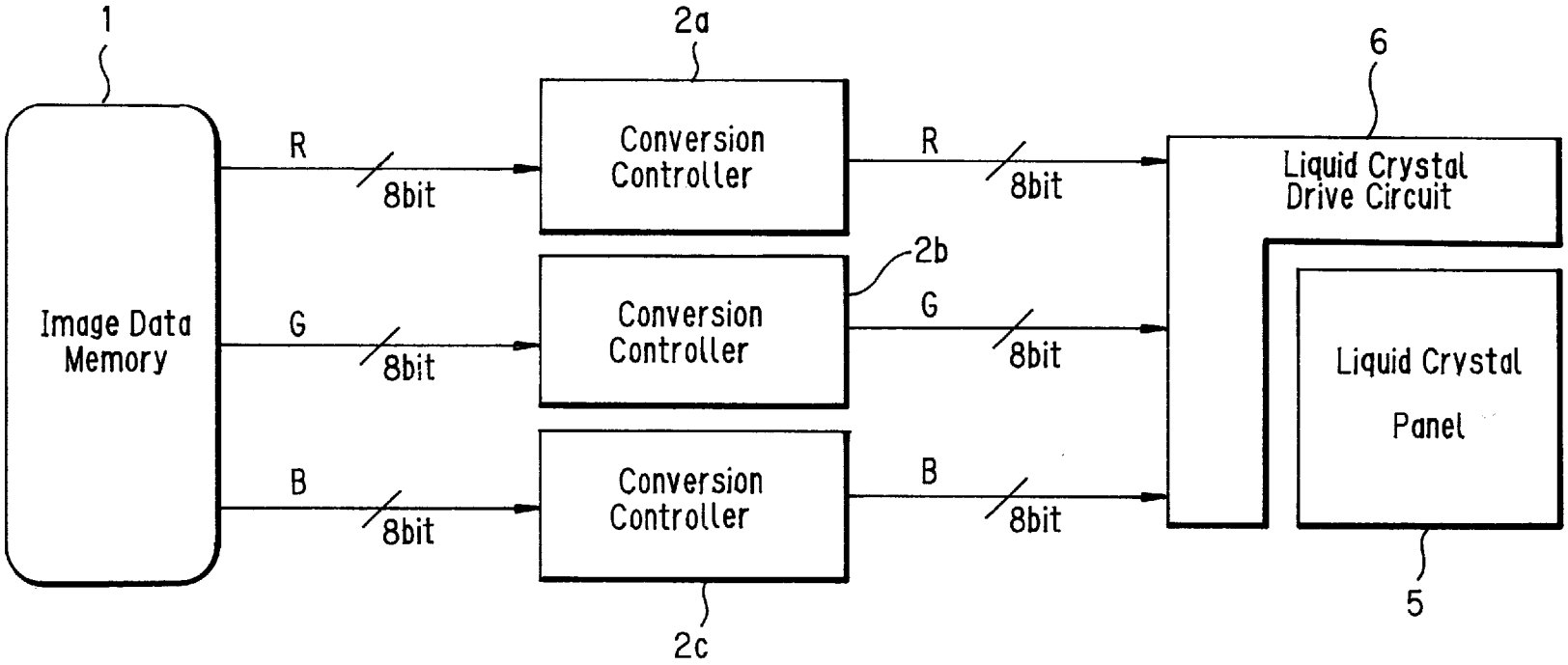
Figure 6:
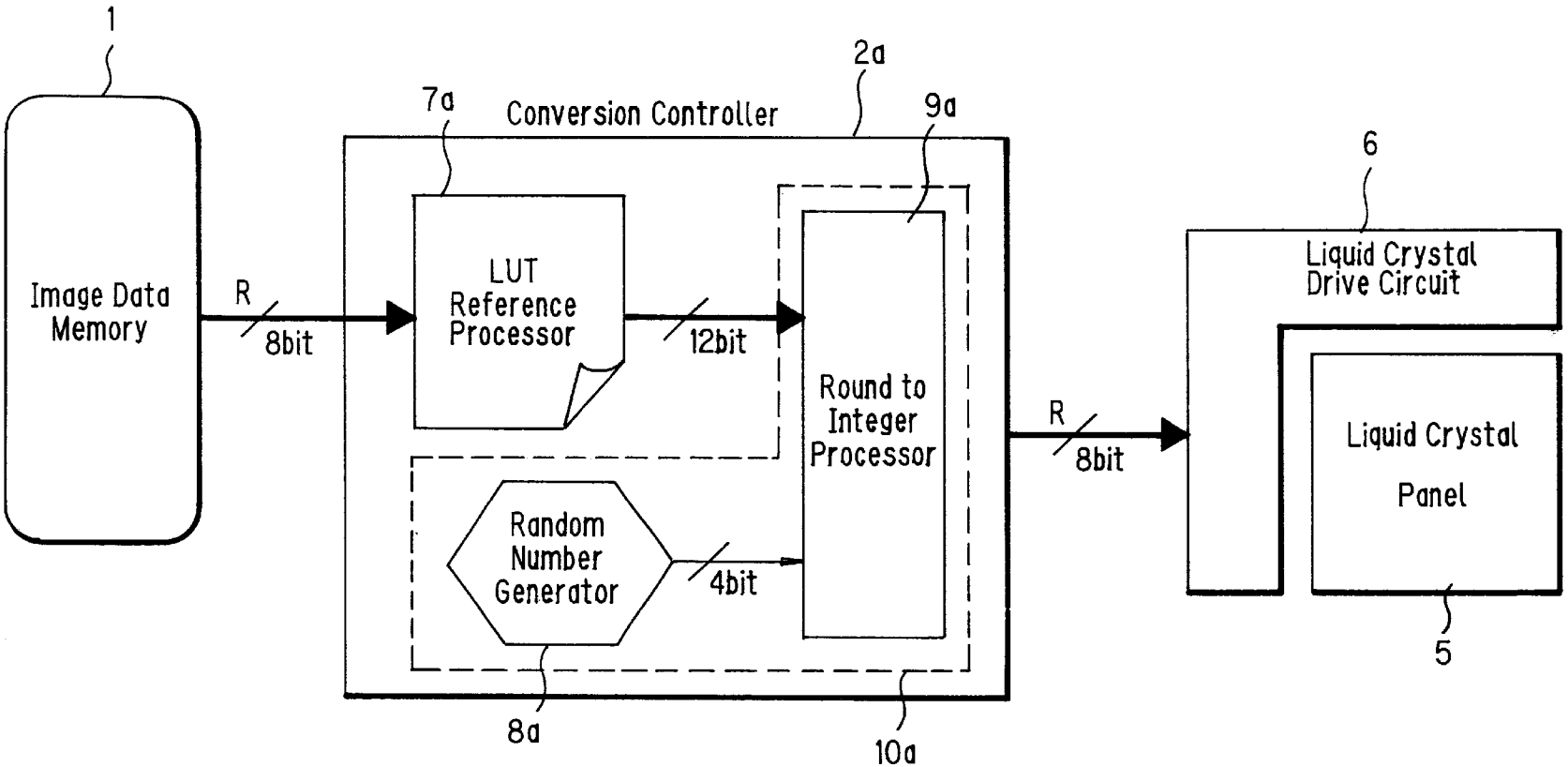
Figure 7:
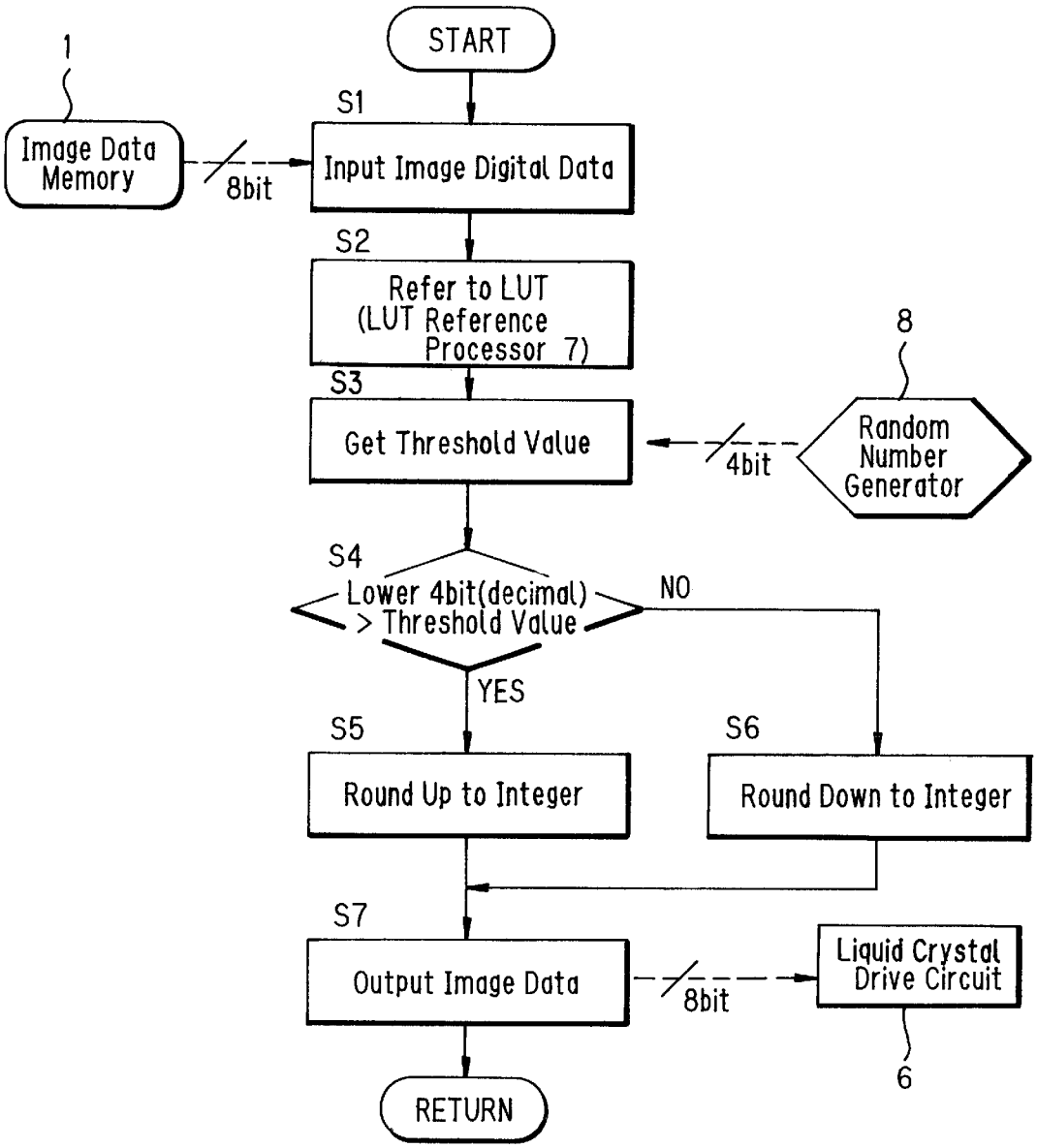
Figure 8:
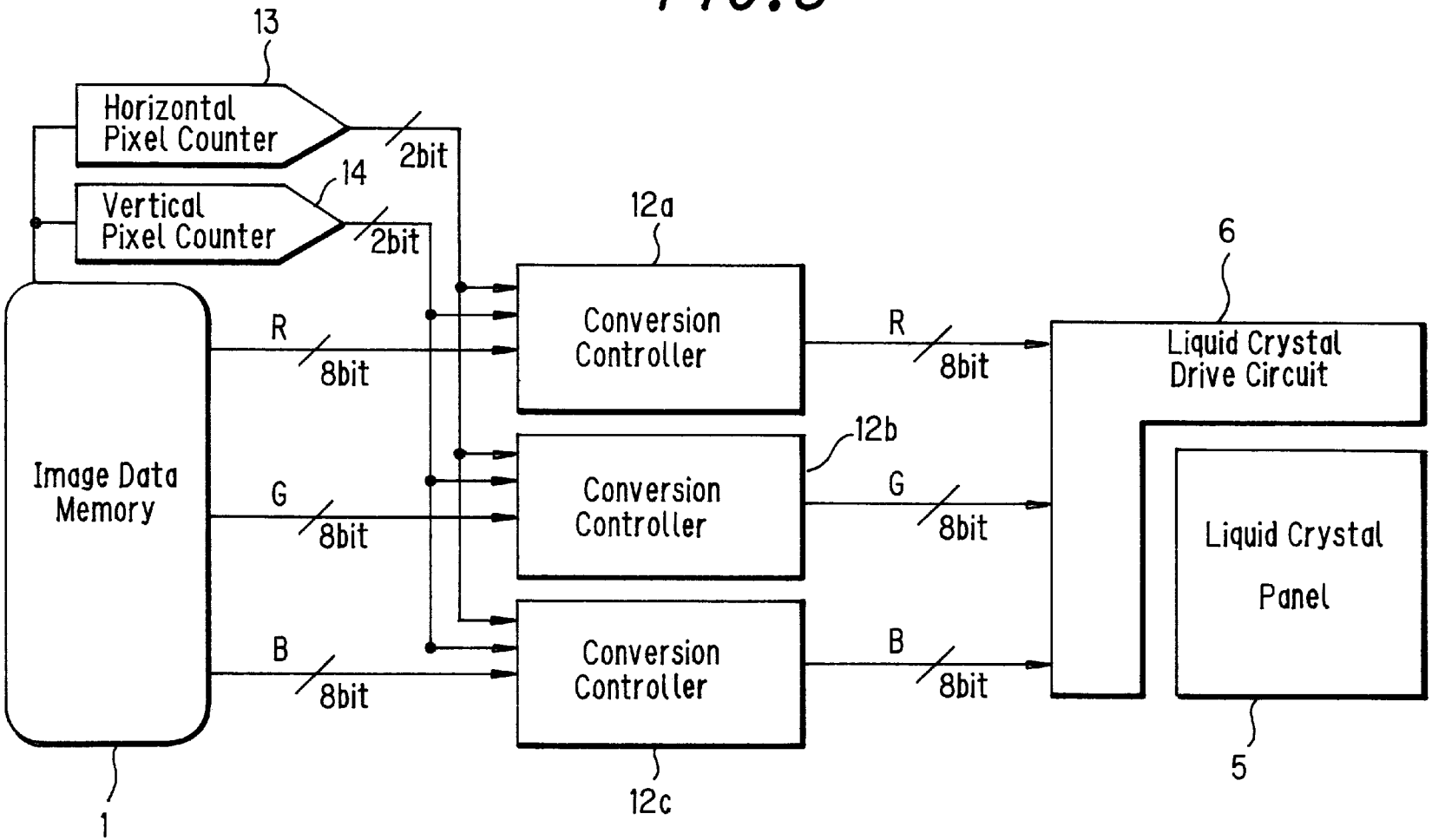
Figures 9, 10:
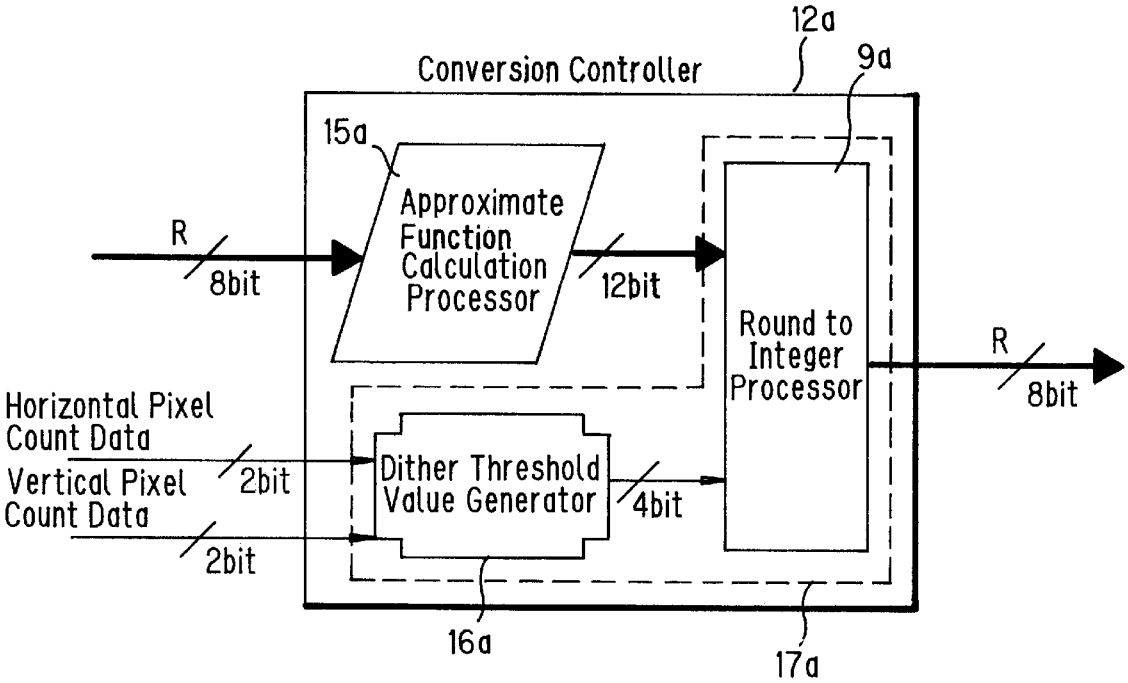
Figure 11:
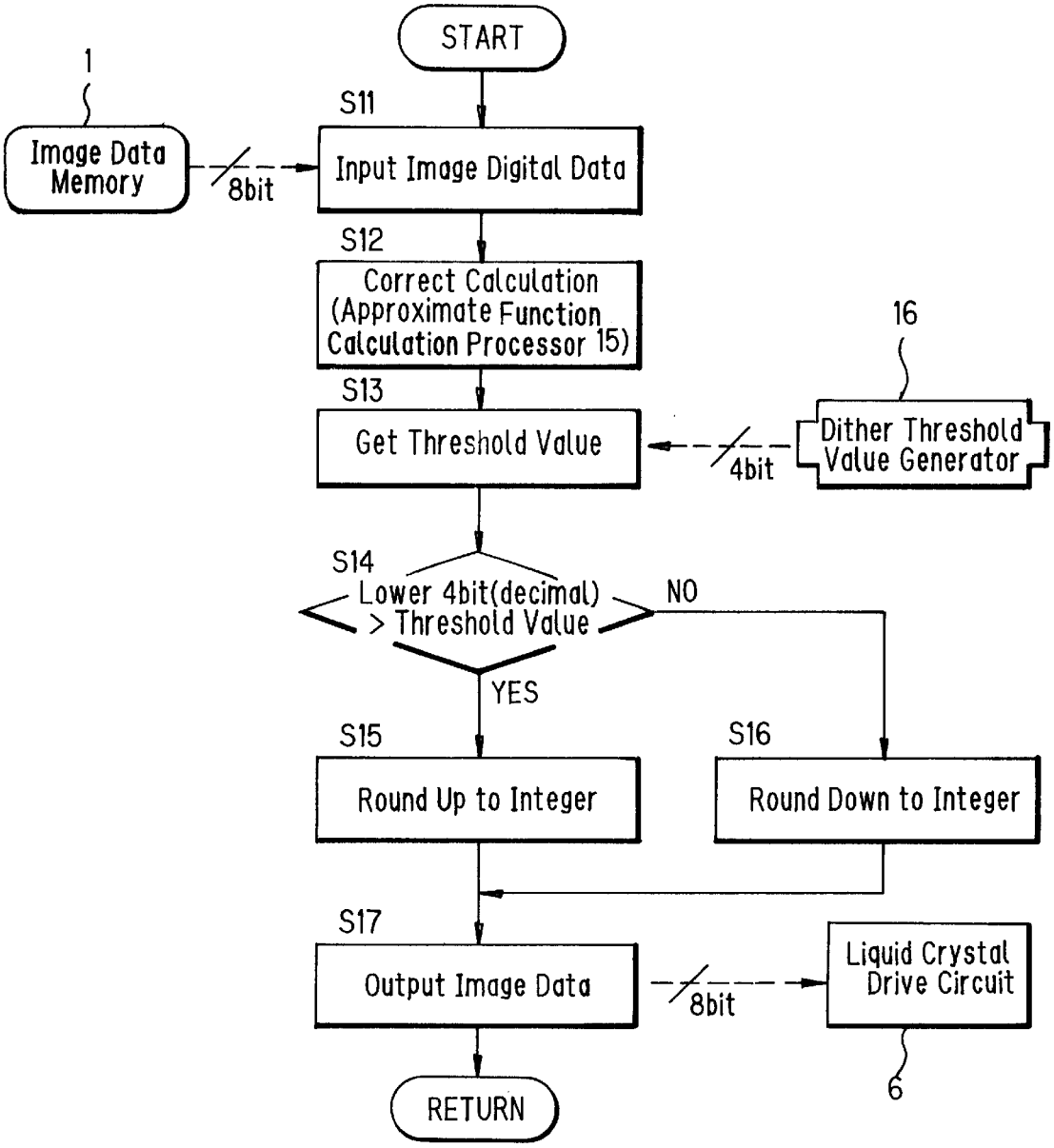
Figure 12:
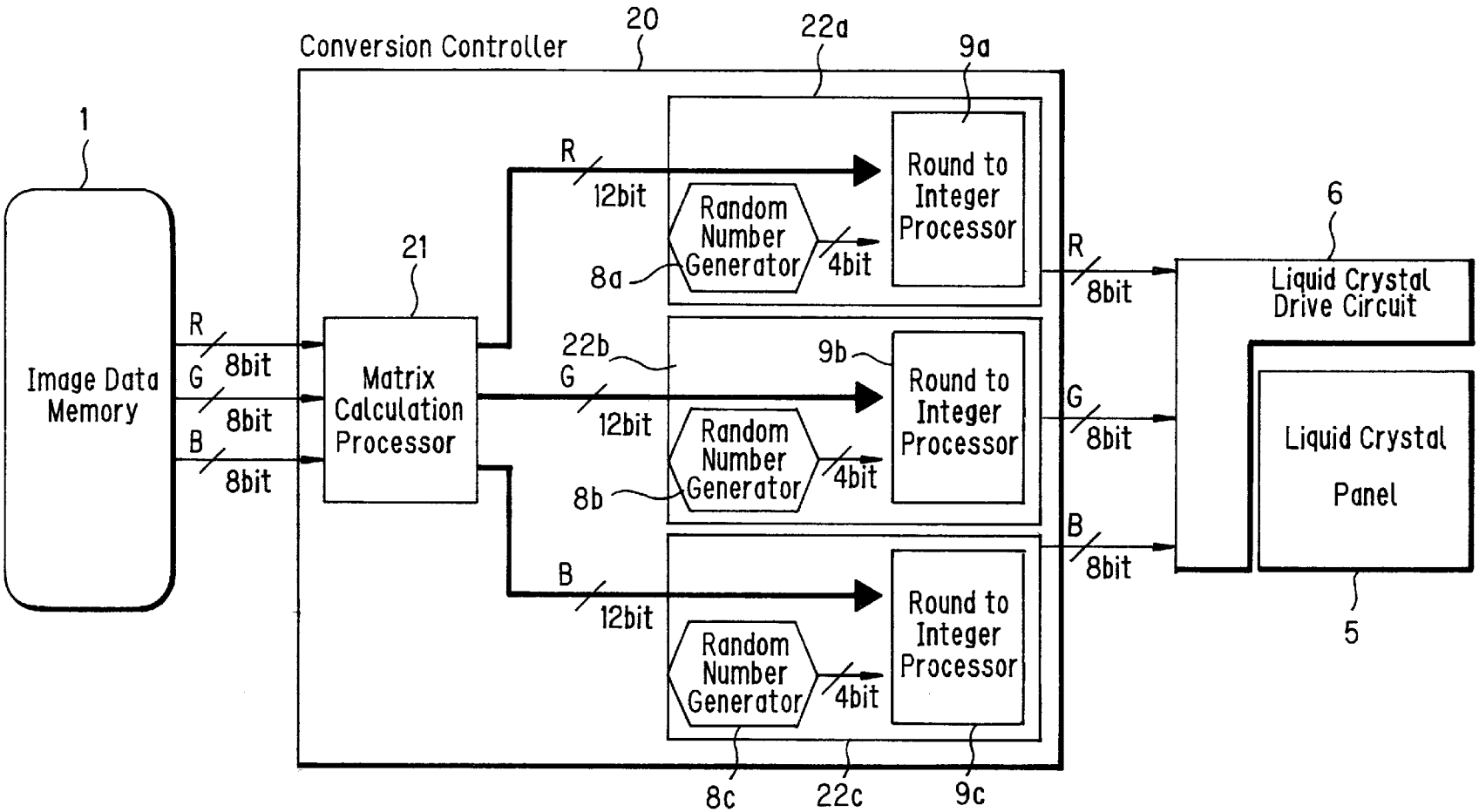
Figure 13:
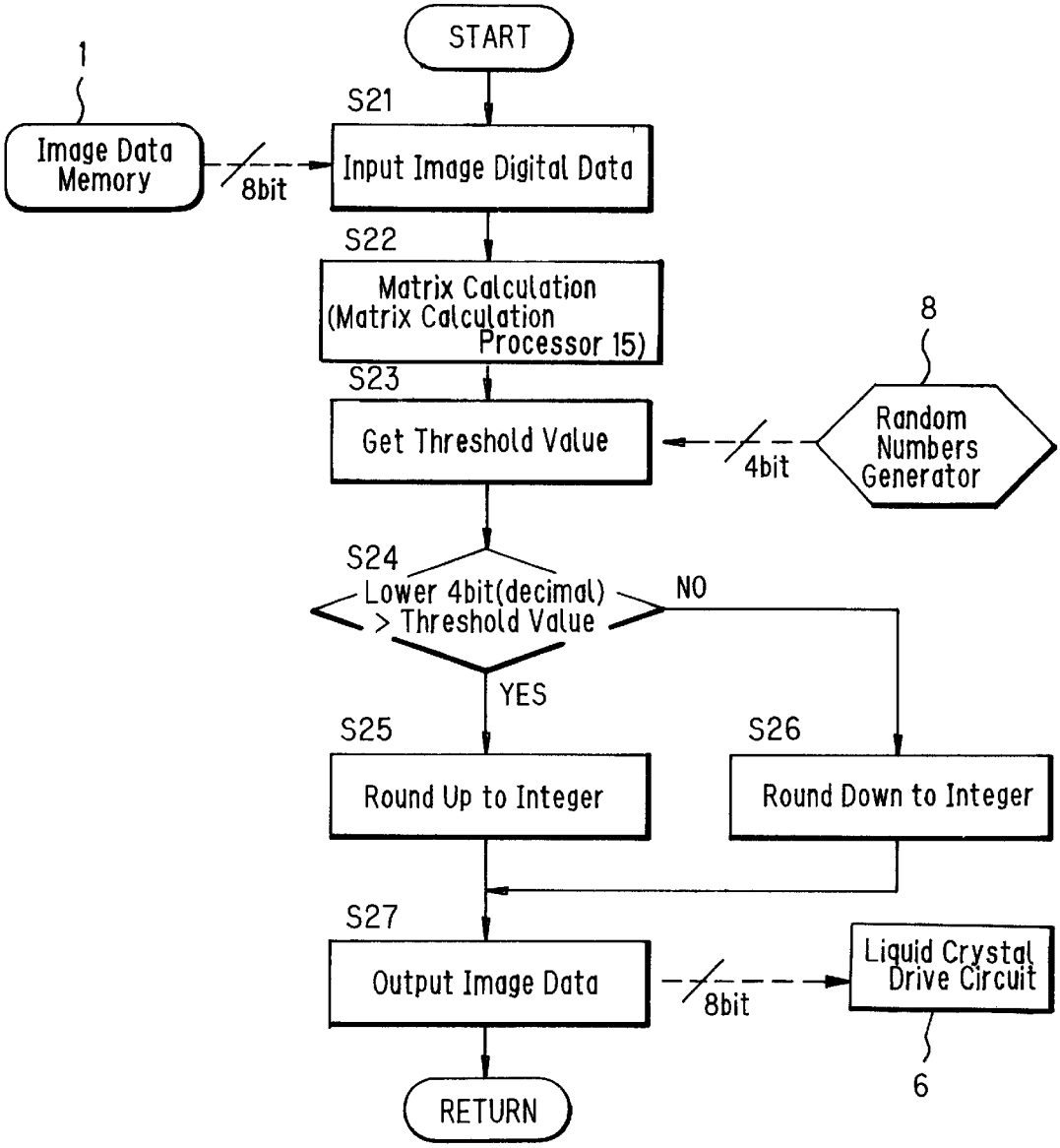
Figure 14:
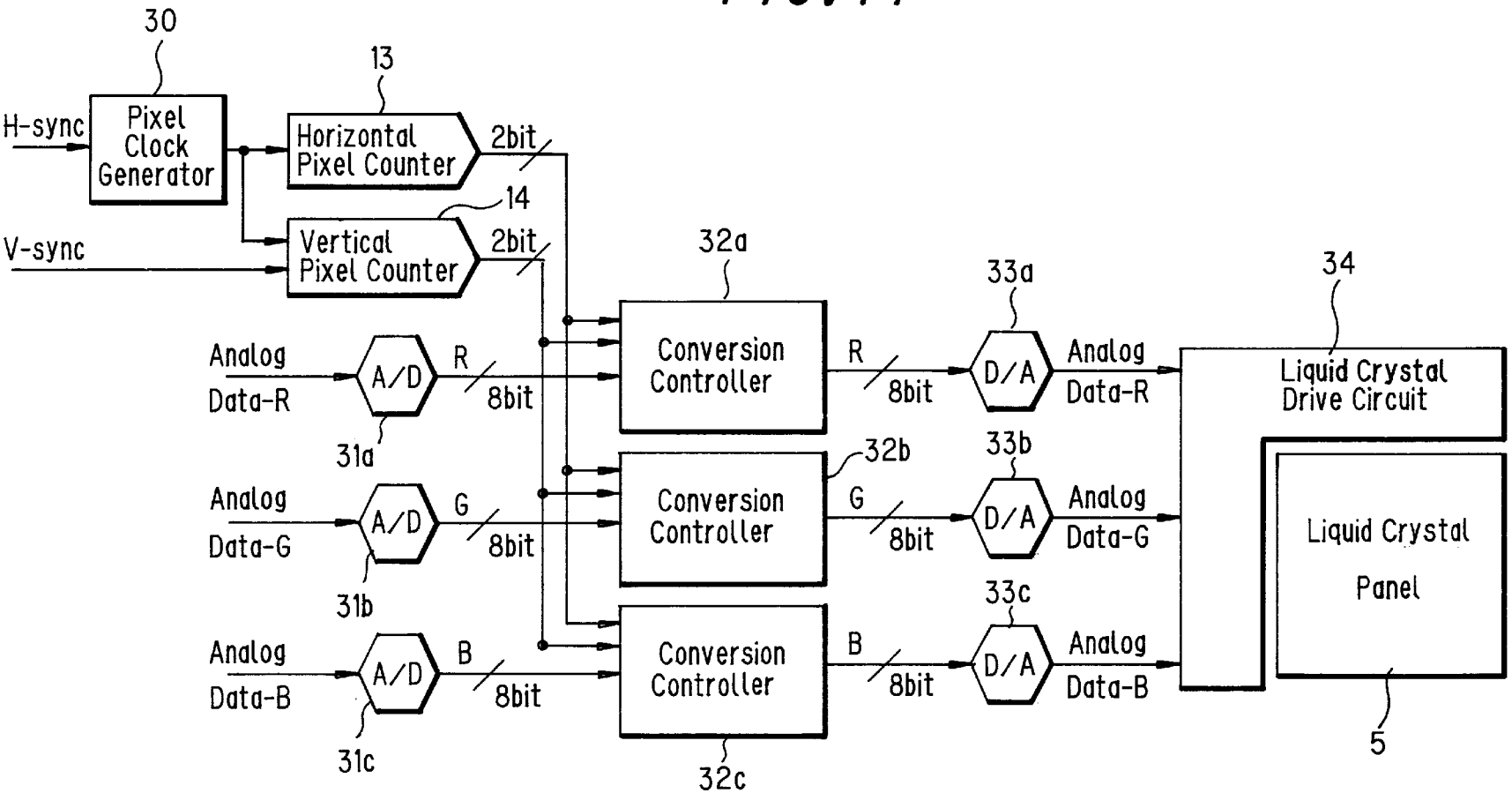
Figure 15:
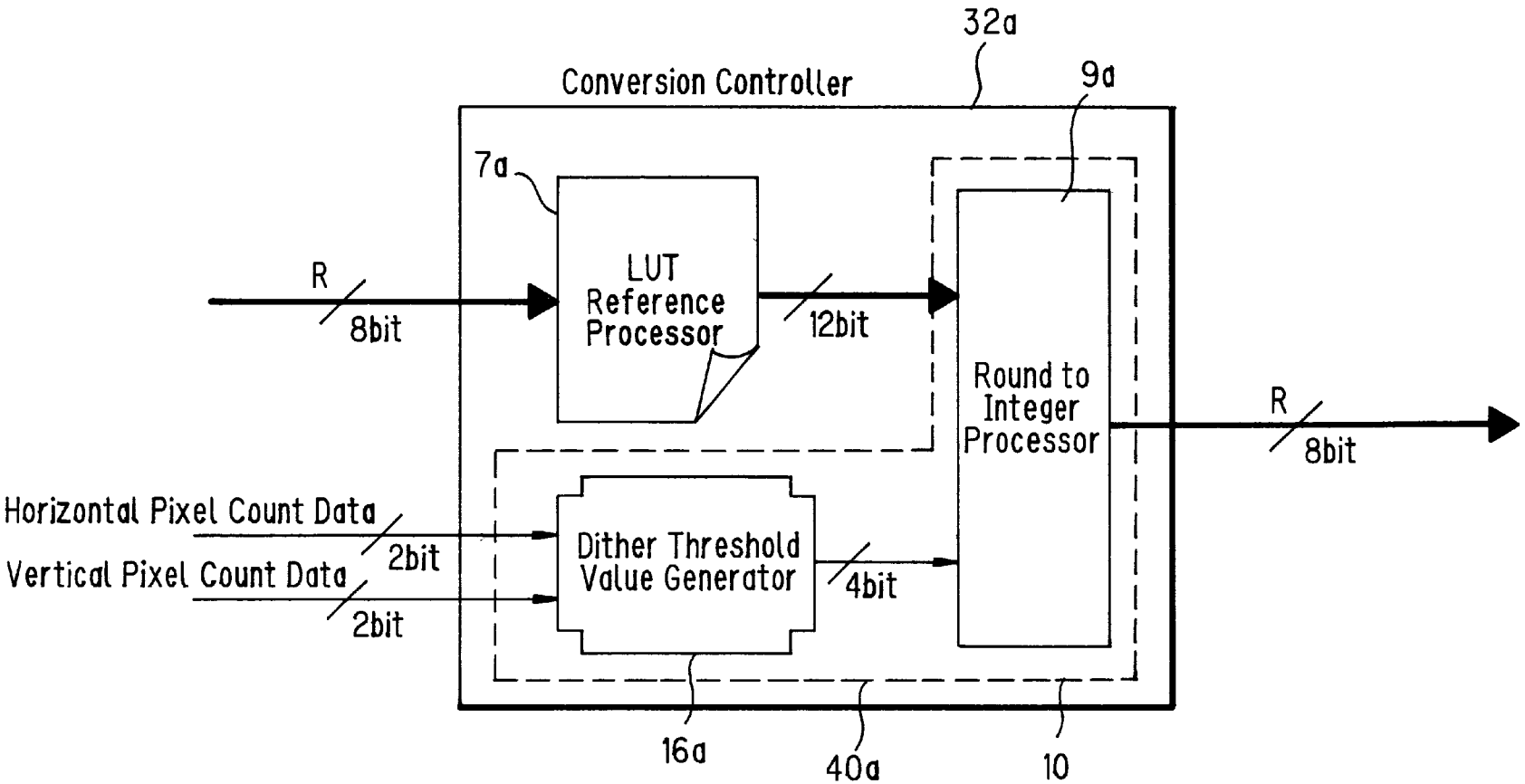
Figure 16:
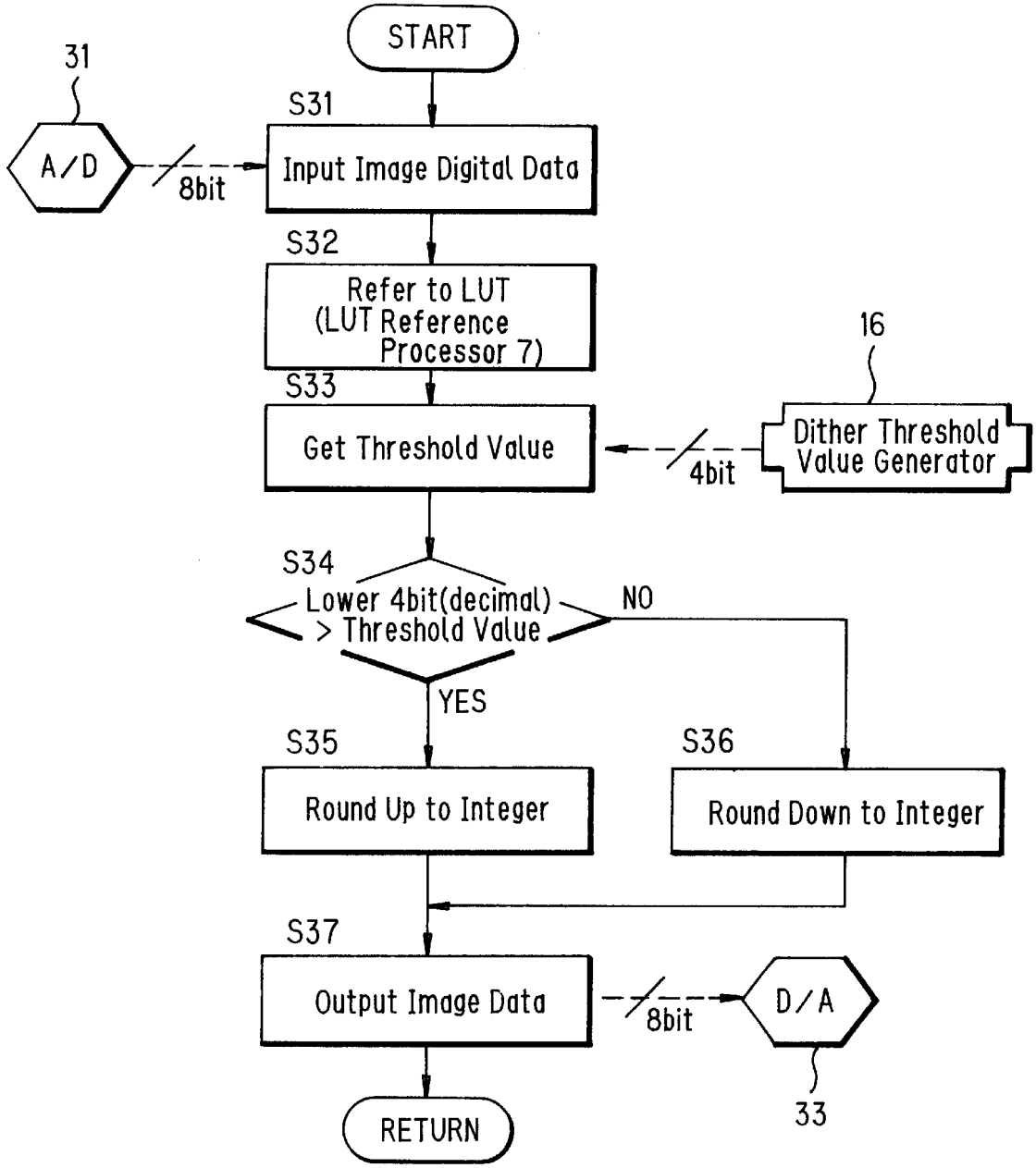

FIG. 1 is a block diagram for explaining a conventional method of driving a liquid crystal, FIG. 2 is a graph for explaining conventional gamma correction of a CRT and luminance characteristics of the CRT, FIG. 3 is a graph for explaining conventional gamma correction of a liquid crystal panel and characteristics of a liquid crystal panel, FIG. 4 is a block diagram showing a conventional liquid crystal display unit having LUT conversion, FIG. 5 is a block diagram showing a first embodiment of a liquid crystal display unit relating to the present invention, FIG. 6 is a block diagram showing a configuration of a conversion controller according to the first embodiment, FIG. 7 is a flowchart for explaining the operation of the conversion controller according to the first embodiment, FIG. 8 is a block diagram showing a second embodiment of a liquid crystal display unit relating to the present invention, FIG. 9 is a block diagram showing a configuration of a conversion controller according to the second embodiment, FIG. 10 is an explanatory diagram showing one example of a four-times-four dither matrix pattern, FIG. 11 is a flowchart for explaining the operation of the conversion controller according to the second embodiment, FIG. 12 is a block diagram showing a third embodiment of a liquid crystal display unit relating to the present invention, FIG. 13 is a flowchart for explaining the operation of the conversion controller according to the third embodiment, FIG. 14 is a block diagram showing a fourth embodiment of a liquid crystal display unit relating to the present invention, FIG. 15 is a block diagram showing a configuration of a conversion controller according to the fourth embodiment, and FIG. 16 is a flowchart for explaining the operation of the conversion controller according to the fourth embodiment.

DETAILE DESCRIPTION OF THE PREFERRED EMBODIMENTS

Embodiments of the present invention will be explained with reference to the accompanied drawings.

First Embodiment

FIG. 5 is a block diagram showing a first embodiment of a liquid crystal display unit relating to the present invention. As shown in FIG. 5, a reference number 1 denotes an image data memory that stores RGB digital image data, 2*a*, 2*b* and 2*c* denote conversion controllers that control conversion of image data of R, G and B respectively, 5 denotes a liquid crystal panel that can output RGB colors, and 6 denotes a digital interface liquid crystal drive circuit that displays supplied digital image data in the liquid crystal panel 5. Eight-bit digital image data of R, G and B respectively that have been output from the image data memory 1 are corrected by the conversion controllers 2*a*, 2*b* and 2*c* to match the liquid crystal panel characteristics. The corrected data are input to the liquid crystal drive circuit 6 as eight-bit digital image data, and are displayed by the liquid crystal panel 5.

FIG. 6 is a block diagram showing the conversion controller 2*a* of the R image data. As shown in FIG. 6, a reference number 7*a* denotes a LUT (a lookup table) reference processor, 8*a* denotes a random number generator, and 9*a* denotes a round-to-integer processor. The random number generator 8*a* and the round-to-integer processor 9*a* constitute color improving means 10*a*. LUT that is stored in the LUT reference processor 7*a* is data of precision of twelve bits consisting of eight bits of an integer+four bits below a decimal point for correcting the characteristics of red of the liquid crystal panel shown in FIG. 3. The LUT reference processor 7*a* stores 256 data (addresses) by a number which makes it possible to refer to the eight bits of input image digital data at the rate of one to one. This LUT can be prepared from data that is a result of measuring the luminance and chromaticity of a predetermined data that has been input to the liquid crystal panel 5. The data structure of the LUT is not limited to the one described in the present embodiment. It is also possible to have a data structure of the LUT in which the number of bits below a decimal point is changed. Alternately, the structure may be the one for carrying out an interpolation processing by decreasing the number of data, instead of making reference to the input data at the rate of one to one.

The random number generator 8*a* generates a random number of four bits, and supplies this number to the round-to-integer processor 9*a* as threshold value data. The round-to-integer processor 9*a* compares the lower-four bit data of twelve-bit data that has been referenced by the LUT reference processor 7*a*, that is, the below decimal portion, with the four-bit threshold value data from the random number generator 8*a*, thereby to carry out a round-to-integer processing.

While the above explains the conversion controller 2*a* of the R image data, the conversion controllers 2*b* and 2*c* of the G and B image data also have similar structures.

Next, the operation of the conversion controller 2*a* will be described.

FIG. 7 is a flowchart for explaining the operation of the conversion controller 2*a* of the R image data. First of all, image digital data is input from the image data memory 1 (S1). Then, the LUT reference processor 7*a* carries out the LUT reference processing, and corrects the input image digital data into twelve-bit data corresponding to the characteristics of the liquid crystal panel (S2). The LUT reference is for obtaining a converted twelve-bit data by referring to an address based on input data, using the LUT that stores twelve-bit data in the address of the input data (0 to 255). Next, four-bit threshold value data is obtained from the random number generator 8*a* (S3). The twelve-bit data that has been corrected at steps S4, S5 and S6 is rounded to obtain an eight-bit integer data. In other words, the lower four bits of the corrected twelve-bit data are compared with the threshold value data (S4). When the threshold value data is smaller than the lower four bits of the corrected twelve-bit data, a decimal portion round-up-to-integer processing is carried out, that is, the eight bits of the integer portion+1 becomes the corrected image data (S5). When the threshold value data is not smaller than the lower four bits of the corrected twelve-bit data, a decimal portion round-down-to-integer processing is carried out, that is, the eight bits of the integer becomes the corrected image data (S6). The eight-bit digital data that has been obtained as the finally corrected data is output to the drive circuit 6 (S7). The conversion controllers 2*b* and 2*c* carry out a similar operation for G and B respectively. The liquid crystal drive circuit 6 drives the liquid crystal panel 5 to display full colors.

Based on the above-described structure, the LUT reference processor 7 as the correcting means carries out a high-precision LUT reference image correction processing to each image data of R, G and B by adding the lower four bits below a decimal point according to the characteristics of the liquid crystal panel 5. Further, the decimal portion is rounded up or rounded down based on the threshold value data from the random number generator 8 of the color improving means 10. Therefore, a fine variation is added to the corrected image signal by the round-to-integer processor 9. Based on the addition of this fine variation, even when a slight coloring occurs in the gray portion due to a fine error of the digital control processing, the color consists of different color components colored by the random number. Therefore, it is possible to reduce the emphasis of the appearance of the coloring due to the color contrast, and to reduce the sensing of a color that does not physically and optically exist at the boundary portion in contact.

Second Embodiment

FIG. 8 is a block diagram showing a second embodiment of a liquid crystal display unit relating to the present invention. Portions that are the same as those of the first embodiment are labeled with identical reference numbers and their explanation will be omitted. As shown in FIG. 8, a reference number 13 denotes a horizontal pixel counter. This horizontal pixel counter 13 is for counting the pixel clock in a horizontal direction in four values at the timing when the image data memory 1 outputs the image data, and for supplying the counted pixel clock to the conversion processors 12*a*, 12*b* and 12*c* as two-bit horizontal count data. A reference number 14 denotes a vertical pixel counter. This vertical pixel counter 14 is for counting the pixel clock in a vertical direction in four values at the timing when the image data memory 1 outputs the image data, and for supplying the counted pixel clock to the conversion processors 12*a*, 12*b* and 12*c* as two-bit vertical count data.

FIG. 9 is a block diagram showing the conversion controller 12*a*, and FIG. 10 shows one example of a four-times-four dither matrix pattern. In the present embodiment, a four-times-four Bayer type dither pattern is used. However, it is also possible to employ a dot-concentrated type matrix or an eight-times-eight matrix to achieve the object. In the four-times-four dither matrix pattern shown in FIG. 10, each value described in each square shows a threshold four-bit data value corresponding to this position.

As shown in FIG. 9, a reference number 15*a* denotes an approximate function calculation processor that is expressed in a hexadecimal number, 16*a* denotes a dither threshold value generator, and 9*a* denotes a round-to-integer processor. The dither threshold value generator 16*a* and the round-to-integer processor 9*a* constitute color improving means 17*a*. The approximate function calculation processor 15*a* stores a polynomial approximation function that is a function for approximating the red luminance curve of the liquid crystal panel 5 shown in FIG. 3, and a function for calculating an inclination of an input image by dividing the input image into each luminance level.

Further, based on the approximation function that is stored, the eight bits of the input image data are digitally corrected to obtain high-precision twelve-bit corrected data of eight bits of an integer portion+lower four bits below a decimal point. This data is then output. The dither threshold value generator 16*a* is for making an output to the round-to-integer processor 9*a* using the four-bit data described in a corresponding square of the four-times-four dither matrix pattern as a threshold value, based on the four-bit horizontal pixel count data and vertical pixel count data that are transmitted from the horizontal pixel counter 13 and the vertical pixel counter 14 respectively. The four-times-four dither matrix pattern is applied repeatedly starting from the left top end of the display screen in the area of the four times four for the column and row respectively as one unit. Therefore, this becomes equivalent to the case where the pattern is applied to the full display screen starting from the left top end of the display screen.

While the structure of the R image data conversion controller 12*a* has been explained above, the G image conversion controller 12*b* and the B image conversion controller 12*c* also have a similar structure respectively.

Next, the operation of the conversion controller 12*a* will be explained. FIG. 11 is a flowchart for explaining the operation of the conversion controller 12*a*. First, the image digital data is input (S11). The approximate function calculation processor 15*a* carries out a digital correction calculation based on an approximate function, thereby to convert the input data into twelve-bit data corresponding to the characteristics of the liquid crystal panel 5 (S12). Four-bit threshold value data is obtained from the dither threshold value generator 16*a* (S13). The lower four bits of the twelve-bit data obtained by the conversion are compared with the threshold value data (S14). When the threshold value data is smaller than the lower four bits of the corrected twelve-bit data, a decimal portion round-up-to-integer processing is carried out, that is, the eight bits of the integer portion+1 becomes the corrected image data (S15). When the threshold value data is not smaller than the lower four bits of the corrected twelve-bit data, a decimal portion round-down-to-integer processing is carried out, that is, the eight bits of the integer becomes the corrected image data (S16). The eight-bit digital data that has been obtained as the finally corrected data is output to the liquid crystal drive circuit 6 (S17).

The conversion controllers 12*b* and 12*c* carry out a similar operation for G and B respectively. The liquid crystal drive circuit 6 drives the liquid crystal panel 5 to display full colors. It is also possible to store different dither matrixes in the conversion controllers 12*b* and 12*c* for G and B respectively. For example, by rotating the matrix by 45 degrees, three kinds of dither matrixes for R. G, and B having different threshold values in the squares can be obtained. By using these matrixes, different variations are added to R, G, and B respectively, and moiré due to a variable interference can be prevented.

Based on the above-described structure, the approximate function calculation processor 15*a* that is the correcting means can carry out the correction according to the characteristics of the liquid crystal panel 5, based on a high-precision approximate function digital calculation with the addition of the four bits below a decimal point. Further, the decimal portion is rounded up or rounded down based on the threshold value data from the dither threshold value generator 16*a* of the color improving means 17*a*. Thus, a fine variation is added to the image signal by the round-to-integer processor 9*a*. Based on the addition of this fine variation, even when a slight coloring occurs in the gray portion, the color consists of different color components. Therefore, it is possible to reduce the emphasis of the appearance of the coloring due to the color contrast, and to reduce the sensing of a color that does not physically and optically exist at the boundary portion in contact.

Further, as compared with the LUT reference processor 7*a* in the first embodiment, the memory for the digital calculation of the approximate function calculation processor 15*a* in the second embodiment can be structured in a smaller scale at lower cost. Further, as the color improving means 17*a* carries out the threshold value processing based on the dither matrix pattern from the dither threshold value generator 16*a*, it is possible to control the addition of the variation. By providing a homogeneous variation without a deviation on the display screen, it is possible to realize a screen of a higher quality than that obtained by the processing based on random number threshold value in the first embodiment.

Third Embodiment

FIG. 12 is a block diagram showing a third embodiment of a liquid crystal display unit relating to the present invention. Portions that are the same as those of the first and second embodiments are labeled with identical reference numbers and their explanation will be omitted. As shown in FIG. 12, reference number 20 denotes a conversion controller. This conversion controller 20 consists of a matrix calculation processor 21 as correcting means, random number generators 8*a*, 8*b* and 8*c*, and round-to-integer processors 9*a*, 9*b* and 9*c*. Color improving means 22*a*, 22*b* and 22*c* consist of the random number generators 8*a*, 8*b* and 8*c* and the round-to-integer processors 9*a*, 9*b* and 9*c*, respectively. The matrix calculation processor 21 stores three-times-three matrix coefficients for carrying out a linear conversion of RGB image digital data according to the characteristics of a liquid crystal panel 5 shown in FIG. 12. These matrix coefficients are obtained by, for example, the method of least squares, from a relationship between the data input to the liquid crystal panel 5 and the measured data of displayed luminance or chromaticity. The matrix calculation processor 21 converts each eight-bit image data of R, G and B input from the image data memory 1 into twelve-bit corrected data of high precision having eight bits of an integer portion+ lower four bits below a decimal point, and outputs the result.

$$R\text{out (12 bit)}=a11*R\text{in (8 bit)}+a12G\text{in (8 bit)}+a13*B\text{in (8 ibt)}$$

$$G\text{out (12 bit)}=a21*R\text{in (8 bit)}+a22G\text{in (8 bit)}+a23*B\text{in (8 ibt)}$$

$$B\text{out (12 bit)}=a31*R\text{in (8 bit)}+a32G\text{in (8 bit)}+a33*B\text{in (8 ibt)}$$

where all to a33 represent three-times-three matrix coefficients.

Next, the operation of the conversion controller 20 will be explained. FIG. 13 is a flowchart for explaining the operation of the conversion controller 20.

First, RGB image digital data are input (S21). The matrix calculation processor 21 carries out a correction processing based on a matrix calculation. Then, three twelve-bit data of R, G and B are output according to the characteristics of the liquid crystal panel 5 (S22). Next, four-bit threshold value data are obtained from the random number generators 8*a*, 8*b* and 8*c* respectively (S23). The corrected twelve-bit data are rounded into eight-bit integer data at steps S24, S25 and S26 respectively. The three eight-bit digital data of R, G and B finally corrected are output to the liquid crystal drive circuit 6 at step S27, and an image is displayed on the liquid crystal panel 5.

Based on the above-described structure, the matrix calculation processor 21 can carry out the correction according to the characteristics of the liquid crystal panel 5, based on a high-precision matrix calculation with the addition of the four bits below a decimal point. Further, the decimal portion is rounded up or rounded down based on the threshold value data from the random number generators 8*a*, 8*b* and 8*c* respectively. Thus, a fine variation is added to the image signal. Based on the addition of this fine variation, even when a slight coloring occurs in the gray portion due to a fine error of the digital control processing, the color consists of different color components. Therefore, it is possible to reduce the emphasis of the appearance of the coloring due to the color contrast, and to reduce the sensing of a color that does not physically and optically exist at the boundary portion in contact. Further, as compared with the LUT conversion and the approximate function conversion of the first and second embodiments, it is possible to realize a processing at a higher speed as the RGB image data are converted in matrix at one time.

Fourth Embodiment

FIG. 14 is a block diagram showing a fourth embodiment of a liquid crystal display unit relating to the present invention. Portions that are the same as those of the first to third embodiments are labeled with identical reference numbers and their explanation will be omitted. As shown in FIG. 14, reference numbers 31*a*, 31*b* and 31*c* denote A/D converters that convert input analog signals into eight-bit digital signals, respectively. Reference numbers 33*a*, 33*b* and 33*c* denote D/A converters that convert eight-bit digital signals into analog signals respectively. A reference number 34 denotes a liquid drive circuit of an analog interface, and 30 denotes a pixel clock generator that generates a pixel clock by a sampling frequency of the liquid drive circuit 34 in synchronism with an input horizontal synchronization signal. The horizontal pixel counter 13 is for counting the input pixel clock in four values, converting this pixel clock into two-bit horizontal count data, and supplying the result to conversion processors 32*a*, 32*b* and 32*c*, respectively. A vertical pixel counter 14 is for counting the pixel clock in a horizontal direction in four values based on horizontal and vertical synchronization signals, and for supplying the counted data as two-bit vertical count data to the conversion processors 32*a*, 32*b* and 32*c*, respectively.

FIG. 15 is a block diagram for explaining the function of the conversion controller 32*a*. In the present embodiment, the conversion controller 32*a* comprises a LUT reference processor 7*a* as correcting means, and a dither threshold value generator 16*a* and a round-to-integer processor 9*a* as color improving means 40*a*. In the fourth embodiment, although their explanation will be omitted here, it is also of course possible to configure the correcting means by an approximate function processor or a matrix calculation processor, and to configure the color improving means by a random number generator.

While the above explains the conversion controller 32*a* of the R image data, the conversion controllers 32*b* and 32*c* of the G and B image data also have similar structures.

The operation of the conversion controller 32*a* will be explained in detail with reference to a flowchart shown in FIG. 16. First, a digital image signal obtained by a conversion by the D/A converter is input (S31). Then, the LUT reference processor 7*a* carries out the LUT reference, and converts the image signal into twelve-bit data corresponding to the characteristics of the liquid crystal panel 5 (S32). A four-bit threshold value data is obtained from the dither threshold value generator 16*a* (S33). The corrected twelve-bit data are rounded into eight-bit integer data at steps S34, S35 and S36 respectively. The eight-bit digital data are finally output to the D/A converters 33*a*, 33*b* and 33*c* respectively at step S37. After the data have been D/A converted, they are supplied to the liquid crystal drive circuit 34. The conversion controllers 32*b* and 32*c* carry out a similar operation for G and B signals respectively. The liquid crystal drive circuit 34 drives the liquid crystal panel 5 to display an image.

Based on the structure of the present embodiment, it is also possible to obtain similar effects to those of the first to third embodiments, in the liquid crystal display panel and the liquid crystal drive circuit of the analog interface of the fourth embodiment. Further, as the above effects can be obtained without requiring an expensive D/A converter having a large number of bits, it becomes possible to reduce the cost.

As is clear from the above explanation, according to the first aspect of the present invention, the correcting means can correct the optical rotary dispersion characteristics that are the phenomenon which is particular to the liquid crystal panel, based on the digital signal control. Further, the color improving means adds a fine variation to the image digital data. Thus, based on the addition of this fine variation, even when a slight coloring occurs in the gray portion due to a fine error of the digital control processing, the color consists of different color components colored by the random number. Therefore, there is an effect that it is possible to reduce the emphasis of the appearance of the coloring due to the color contrast, and to reduce the sensing of a color that does not physically and optically exist at the boundary portion in contact.

Further, according to the second and the third aspects, it is also possible to obtain the above effect of the first aspect of the present invention by the liquid crystal drive circuit either of the digital interface or of the analog interface.

Further, according to the fourth aspect, the input image digital data is corrected by referring to the LUT that consists of bits of a larger number than that of the input data. Therefore, there is an effect that it is possible to carry out a more accurate and detailed correction.

Further, according to the fifth aspect, as the data correction is carried out using an approximate function, there is an effect that the memory for the calculation can be structured in a small scale at low cost.

Further, according to the sixth aspect, as the data are corrected by linear matrix conversion, the image digital data is converted in matrix at one time. Therefore, there is an effect that the memory for the calculation can be structured in a small scale. Further, there in an effect that the processing can be carried out at higher speed.

Further, according to the seventh to the ninth aspects, a fine variation is added by rounding the data into an integer based on a random number threshold value. Therefore, there is an effect that it is possible to provide the apparatus of the invention in a simple structure at low cost.

Further, according to the tenth to the twelfth aspect, a fine variation is added by rounding the data into an integer based on a threshold value obtained from the dither matrix pattern. Therefore, there is an effect that it is possible to control the additional variation. As a result, it is also possible to add a homogeneous variation to the image, which improves the picture quality.

Further, according to the thirteenth to the fifteenth aspects, a dither matrix pattern is prepared for each image digital data, and different variations are added to the RGB image data. Therefore, there is an effect that it is possible to avoid moire due to a variable interference.

What is claimed is:

1. A liquid crystal display unit comprising:

a liquid crystal panel that can display a color image;

a liquid crystal drive circuit that drives the liquid crystal panel; and a conversion controller that controls the conversion of image digital data consisting of digital signals of R, G, B respectively, and supplies the converted data to the liquid crystal drive circuit, wherein the conversion controller comprises:

correcting means that corrects the image digital data having a number of bits by outputting corrected image digital data, having bits below a decimal point and having a larger number of bits than the image digital data, in order to carry out a color reproduction that meets characteristics of the liquid crystal panel; and color improving means for generating a threshold value and changing the corrected image digital data to an integer based on said generated threshold value, thereby adding a fine variation to the corrected image digital data.

2. The liquid crystal display unit according to claim 1, further comprising:

an image data memory that stores image digital data and supplies it to the conversion controller, wherein the liquid crystal drive circuit is driven by digital signals from the conversion controller.

3. The liquid crystal display unit according to claim 1, further comprising:

an A/D converter that converts analog input signals of R, G and B respectively that are color image signals input from the outside of the unit into digital signals, and supplies the digital signals to the conversion controller; and a D/A converter that converts image digital data from the conversion controller into analog signals, and supplies the analog signals to the liquid crystal drive circuit, wherein the liquid crystal drive circuit is driven by analog signals from the D/A converter.

4. The liquid crystal display unit according to claim 1, 2 or 3, wherein the correcting means carries out a correction by referring to a lookup table consisting of characteristic data of the liquid crystal panel, and each data of the lookup table that becomes the corrected data has bits of a larger number than the number of bits of the image digital data.

5. The liquid crystal display unit according to claim 1, 2 or 3, wherein the correcting means carries out a correction calculation using a functional expression by approximating characteristic data of the liquid crystal panel, and the corrected data has bits of a larger number than the number of bits of the image digital data.

6. The liquid crystal display unit according to claim 1, 2 or 3, wherein the correcting means carries out a correction by linearly matrix converting the image digital data using a matrix coefficient that has been calculated from characteristic data of the liquid crystal panel, and the corrected data has bits of a larger number than the number of bits of the image digital data.

7. The liquid crystal display unit according to claim 4, wherein the color improving means has a random number generator that generates a random threshold value, and changes the corrected data into an integer by the random threshold value, thereby to add a fine variation.

8. The liquid crystal display unit according to claim 5, wherein the color improving means has a random number generator that generates a random threshold value, and changes the corrected data into an integer by the random threshold value, thereby to add a fine variation.

9. The liquid crystal display unit according to claim 6, wherein the color improving means has a random number generator that generates a random threshold value, and changes the corrected data into an integer by the random threshold value, thereby to add a fine variation.

10. The liquid crystal display unit according to claim 4, wherein the color improving means stores a dither matrix pattern, and changes the corrected data into an integer by a threshold value obtained from the dither matrix pattern, thereby to add a fine variation.

11. The liquid crystal display unit according to claim 5, wherein the color improving means stores a dither matrix pattern, and changes the corrected data into an integer by a threshold value obtained from the dither matrix pattern, thereby to add a fine variation.

12. The liquid crystal display unit according to claim 6, wherein the color improving means stores a dither matrix pattern, and changes the corrected data into an integer by a threshold value obtained from the dither matrix pattern, thereby to add a fine variation.

13. The liquid crystal display unit according to claim 10, wherein the color improving means stores the dither matrix patterns separately in the image data of R, G and B respectively, and can change a variation that is added to the image data of R, G and B respectively.

14. The liquid crystal display unit according to claim 11, wherein the color improving means stores the dither matrix patterns separately in the image data of R, G and B respectively, and can change a variation that is added to the image data of R, G and B respectively.

15. The liquid crystal display unit according to claim 12, wherein the color improving means stores the dither matrix patterns separately in the image data of R, G and B respectively, and can change a variation that is added to the image data of R, G and B respectively.

* * * * *